US006149517A

United States Patent [19]

Hansen

[11] Patent Number: 6,149,517

[45] Date of Patent: Nov. 21, 2000

[54] END-VENTILATING ADJUSTABLE PITCH ARCUATE ROOF VENTILATOR

[75] Inventor: Jeffery E. Hansen, Cedar Hill, Tex.

[73] Assignee: CertainTeed Corporation, Valley Forge, Pa.

[21] Appl. No.: 09/447,666

[22] Filed: Nov. 23, 1999

[51] Int. Cl.[7] ..... F24F 7/02

[52] U.S. Cl. ..... 454/365; 52/199

[58] Field of Search ..... 52/199; 454/365, 454/366, 367

[56] References Cited

U.S. PATENT DOCUMENTS

| | | | |
|---|---|---|---|
| 5,009,149 | 4/1991 | MacLeod et al. | 454/365 |
| 5,095,810 | 3/1992 | Robinson | 454/365 |
| 5,122,095 | 6/1992 | Wolfert | 454/365 |
| 5,458,538 | 10/1995 | MacLeod et al. | 454/365 |
| 5,772,502 | 6/1998 | Smith | 454/365 |

*Primary Examiner*—Harold Joyce
*Attorney, Agent, or Firm*—Paul & Paul

[57] ABSTRACT

A roof ridge ventilator is provided, comprising preferably a molded ventilator, with openings along the sides thereof for passage of air therethrough and with openings at ends thereof for passage of air therethrough via gaps provided in pluralities of rows of tabs, with a plurality of tabs being in each row, to define circuitous paths for air passage through end walls of the ventilator, with the ventilator being arcuately bendable to accommodate roofs of different pitches and resistance to fold lines being formed in its upper surface when it is arcuately bent, and with a filter medium provided beneath the ventilator.

3 Claims, 3 Drawing Sheets

END-VENTILATING ADJUSTABLE PITCH ARCUATE ROOF VENTILATOR

BACKGROUND OF THE INVENTION

The present invention is addressed to a roof vent for accommodating a variety of roofs, that vary in pitch.

In the art of building construction, it is commonplace that roofs have slopes extending downwardly from each side of a ridge, or apex. Depending upon the style of the construction, such can be of greater pitch or lesser (flatter) pitch. Generally, there is an attic space beneath the roof. It is generally desirable to provide for ventilation of the attic space.

It is also known to provide a roof ridge ventilator to be installed over the open ridge, and then to shingle over the central portion of the ventilator that overlies the open ridge, allowing for air passage between the attic and the outside ambient, via openings through outer side edges of the ventilator.

An example of a desirable adjustable roof ridge ventilator is set forth-in U.S. Pat. No. 5,122,095 to Wolfert, the complete disclosure of which is herein incorporated by reference.

U.S. Pat. No. 5,772,502 also teaches a ventilator for roofs of varying pitches, allowing for ventilation via sides of the ventilator overlying a ridge, but wherein the ventilator at opposite ends of the roof forms a continuous seal against the roof, without having any gaps, slots or holes through the end walls of the roof ventilator, in order to prevent passage of insects, bugs and the like through ends of the roof ventilator.

Other prior art attempts at roof ridge ventilators exist in U.S. Pat. Nos. 5,009,149 and 5,458,538, in which depending tabs, sometimes slidably overlapping, allow for slight air passage between the attic and the outside ambient.

A number of prior art attempts at making roof ridge ventilators that are flexible for accommodating roofs of different pitches, have introduced an undesirable feature whereby, when the ventilators are attempted to be bent arcuately to accommodate a roof of steep pitch, the ventilator will fold along one or more lines that are paralleled to the apex of the roof, rather than gently, arcuately bending. When such a fold line occurs, the subsequent shingling across the top of the ventilator can result in a crack in the shingle as it is bent for nailing to the top of the ventilator. If there are more than one such fold line parallel to the apex of the roof, there may be more than one such sharp bend of the shingle. Such sharp bends can tend to make the shingle at the top central portion of the ventilator crack, producing a very undesirable feature.

Also, when ventilators have end walls that are continuous, such continuous end walls can tend to resist the arcuate bending of the ventilator that may be necessary to accommodate roofs of steeper pitch.

SUMMARY OF THE INVENTION

The present invention is directed toward providing a roof ventilator, for roofs of various pitches, in which gaps in end walls of the ventilator reduce resistance to arcuate bending of the ventilator when the ventilator needs to accommodate more steeply pitched roofs, thereby avoiding fold lines as the ventilator is bent and in which substantial air passages exist between the inside of the ventilator and the outside ambient. The air passages comprise a plurality of rows of tabs, with gaps between adjacent tabs in a given row, and with gaps between the rows of tabs, and wherein the gaps together provide circuitous paths for air passage between the interior of a roof and the outside ambient across ventilator end walls, when the ventilator is installed on a roof. The gaps between tabs in a given row reduce the resistance the end walls may otherwise provide to bending of the ventilator and help in avoiding fold lines as the ventilator is arcuately bent.

It is another object to accomplish the above object, such that breezes or other airflow parallel to the apex of the roof ridge can create a lower pressure zone to draw air outwardly of an attic via an end of ventilator at the end of a roof, such that the attic over which a ventilator is installed may be ventilated when breezes or winds are not impinging upon the ventilator from a direction substantially transverse to the apex of the roof.

Other objects and advantages of the present invention will be readily apparent from a reading of the following brief descriptions of the drawing figures, the detailed description of the preferred embodiment, and the appended claims.

BRIEF DESCRIPTION OF THE DRAWING FIGURES

DETAILED DESCRIPTION OF THE PREFERRED EMBODIMENT

Figure 1:
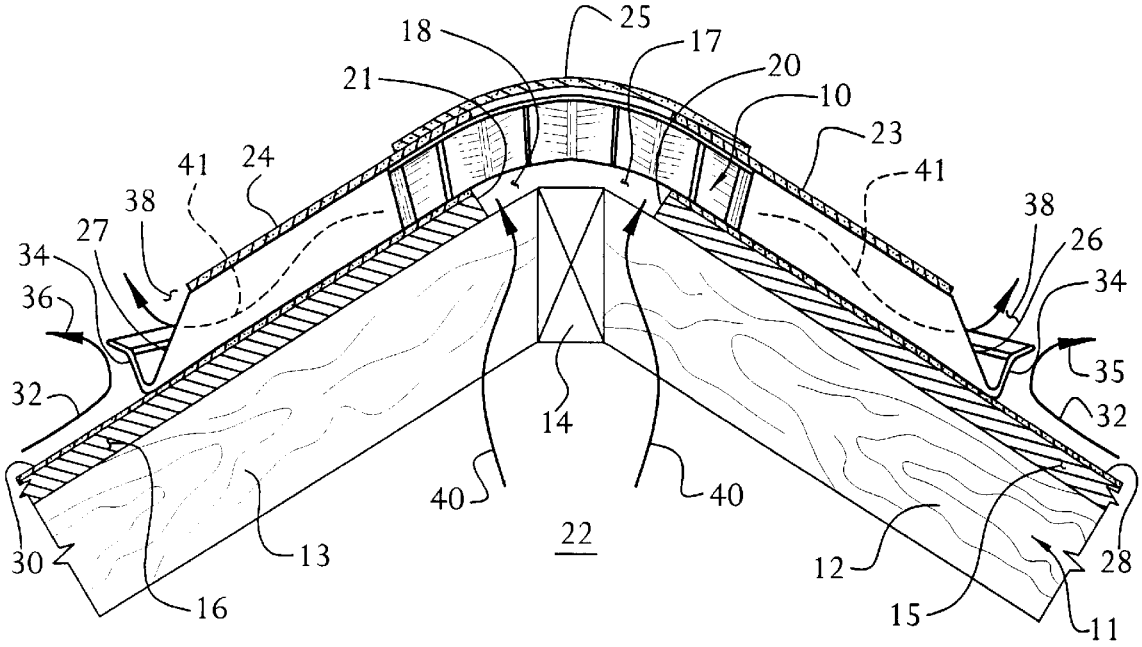
FIG. 1 is a fragmentary vertical sectional view taken through and end-ventilating adjustable pitch roof ventilator in accordance with this invention, transversely thereof, and taken through a fragmental portion of a shingled roof to which the ventilator is applied.

Referring now to the drawings in detail, reference is first made to FIG. 1, wherein a molded, somewhat flexible ventilator in accordance with this invention, generally designated by the numeral 10, is shown applied to the ridge of a roof generally designated by the numeral 11. The roof is comprised of a number of transverse rafters 12 and 13, of a given pitch, as shown, secured to a longitudinal ridge beam 14, extending longitudinally along the apex of the roof. Plywood or other roof boards 15, 16, are shown, nailed or otherwise secured by means (not shown) to the rafters 12, 13, in a conventional manner, leaving vent openings 17, 18 between the ends 20, 21 of the roof boards, 15, 16, in conventional manner, for air from an attic 22 to pass through vent openings, 17, 18, to the outside ambient, as will be described hereinafter.

Shingles 23, 24, and at the apex, a shingle 25, is provided over the top of the ventilator 10 in conventional manner, leaving air to pass from the attic 22, outwardly of the ventilator via openings in sides 26, 27 of the ventilator.

Accordingly, as wind or breezes pass transversely of the ridge, generally flowing upwardly along the shingled surfaces 28 or 30 of a roof, in the direction of one of the arrows 31 or 32 shown in FIG. 1, it will encounter one of the baffles 34 and be deflected backwardly, as shown at 35 or 36, thereby creating a low pressure zone outside the ventilator sides 26, 27, at 38, along one of the ventilator sides 26 or 27. Such a low pressure zone 38 will then draw air from the attic 22, in the directions of the solid lines 40 and dotted lines 41, outwardly through vent openings 17 and 18, and out through openings 47 at one side 26 or 27 of the ventilator, as shown in FIG. 1.

Figure 2:
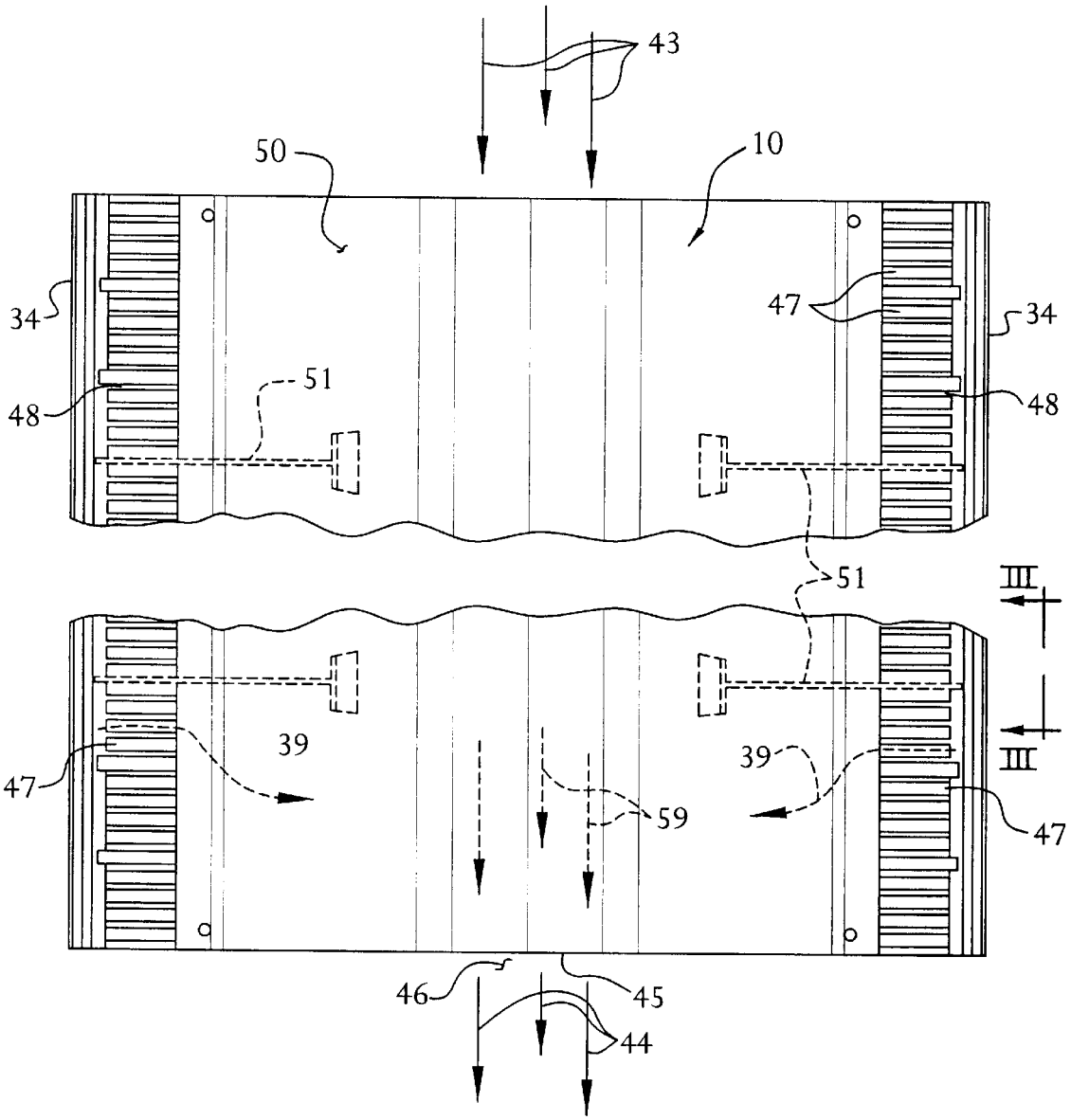
FIG. 2 is a fragmentary, enlarged, top plan view of the ventilator of FIG. 1, with the center portion cut away, as a drafting expedient.
Figure 3:
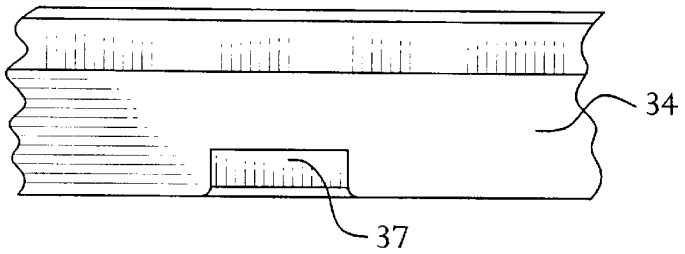
FIG. 3 is an enlarged side elevational view of a portion of the ventilator of FIG. 2, generally taken along the line III—III of FIG. 2.

With reference to FIG. 2, it will be seen that a ventilator 10 may operate to enable the drawing of air outwardly from an attic 22, in the event that wind or breeze flow is parallel to, as distinguished from transverse to, the apex of the roof. In this regard, wind or breeze is shown by the arrows 43, 44, flowing in a longitudinal direction, parallel to the apex of a roof, for drawing air flow from an attic to the outside ambient, via the end wall 45 of a ventilator 10, at the end of a roof, by creating a low pressure zone 46, just outside the end wall of a ventilator past which a breeze or wind is blowing, such that air is drawn from the attic to the outside ambient in the direction of the dotted lines 59, through openings in the end wall 45 of the ventilator, as well as through slotted openings 47 in side walls 48, in the direction of dotted arrows 39.

Figure 6:
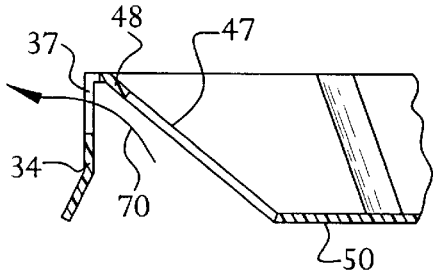
FIG. 6 is an enlarged, fragmentary, detailed view of the left side of the ventilator of FIG. 5, in the portion identified as FIG. 6 thereof.

The sides of the ventilator 10 as with U.S. Pat. No. 5,122,095, are provided with a plurality of slotted openings 47 in sidewalls 48, connecting the top 50 of the ventilator with baffles 34 on each side as shown in FIG. 6 hereof.

Beneath the ventilator are a plurality of brace members 51 for spacing the lower surface 52 of the ventilator 10 above a roof.

Also, as with U.S. Pat. No. 5,122,095, weep holes 37 are provided in baffles 34, for passage of rainwater therethrough.

Figure 4:
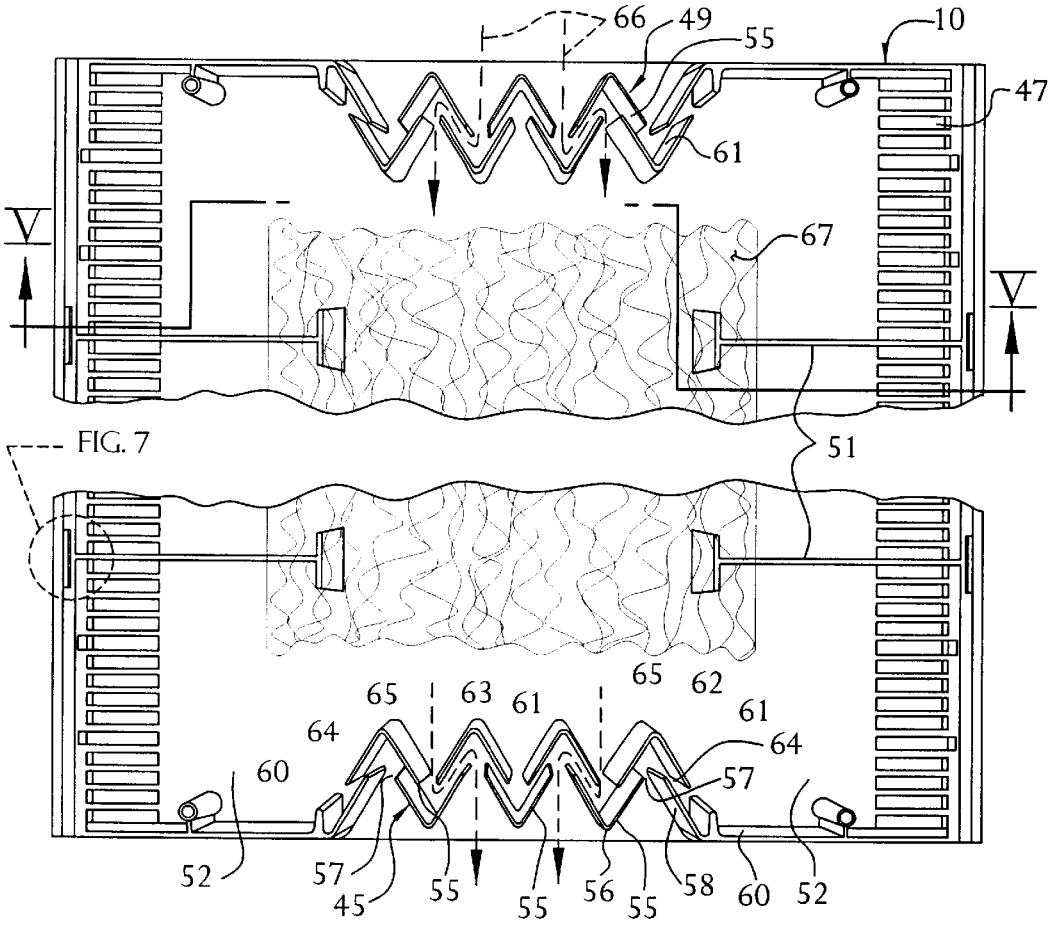
FIG. 4 is a bottom view of the ventilator of FIG. 2, with the central portion cut away as in FIG. 2, and wherein the circuitous paths for air passage between the interior of a roof and the outside ambient across ventilator end walls, through the gaps in rows of tabs and through the gaps between rows of tabs, is clearly illustrated.

With reference now to FIG. 4, it will be seen that opposite end walls 45, 49 of the ventilator 10 are provided, each in the form of two parallel rows of tabs depending from and integral with the bottom surface 52 of the ventilator 10. Each of the end walls 45, 49, is similarly constructed, so only one need be described in detail.

A first row of tabs 55 is provided, with the tabs 55 being generally V-shaped as shown in FIG. 4, in each case with the apex 56 of the "V" facing outwardly of the ventilator, defining first gaps 57 between legs of adjacent tabs 55. At each end of the row of tabs 55, a half of a V-shaped tab 58 is provided, as shown, connected to the remainder of the ventilator end wall 60, as shown.

Longitudinally inwardly of the ventilator 10, a second row of tabs 61 is provided, each also V-shaped, but with the apex 62 of each of the tabs 61 in the second row facing toward the opposite end 49 of the ventilator 10, and with gaps 63 likewise being provided between adjacent tabs in the second row of tabs 61, and comprising second gaps.

Third gaps 64 are provided between legs of tabs 55 and adjacent legs of tabs 61, or in the case of legs of end tabs 61, between those legs of end tabs 61 and half tabs 58 in the first row.

It will thus be clear that, when wind or breezes flow as indicated in solid lines 43, 44, in FIG. 2, air from inside the attic beneath the surface 52 of the ventilator 10 may flow in circuitous paths 65, from the inside of the ventilator to the outside ambient, as shown by the dotted lines 65. As air flows outwardly in the direction of the dotted arrows 65, air will naturally be drawn into the attic from the outside ambient, as indicated by the dotted arrows 66 and 39, being drawn into the attic through the opposite end wall 49 of the roof via the first, second and third gaps between tabs and rows of tabs of the opposite end wall 49 of ventilator 10, as shown in FIG. 4.

It will also be seen that in FIG. 4 a filter 67 is provided beneath the ventilator 10, of fiberglass mesh construction or the like, for filtering out insects, snow, rain, etc., while allowing sufficient air flow therethrough to accomplish the purposes of this invention.

Figure 7:
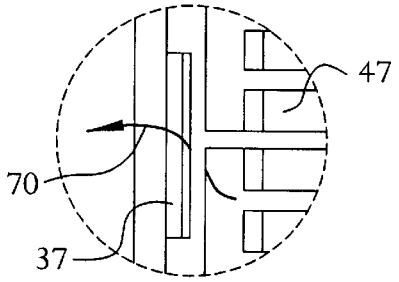
FIG. 7 is an enlarged, fragmentary, detailed view of the portion of the ventilator of FIG. 4 identified as FIG. 7 therein.
Figure 5:
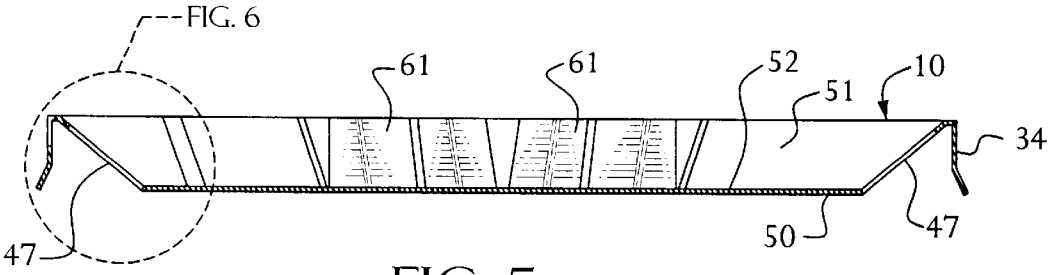
FIG. 5 is a transverse sectional view taken through the ventilator of FIG. 4, generally along the line V—V of FIG. 4.

With reference now to FIG. 5, it will be seen that the slots 47 are shown between the top 50 of the ventilator and the baffles 34, and in enlarged detail 6 it is more clearly shown how rain may pass through weep openings 37, in the direction of arrow 70, with it being understood that the illustrations of FIGS. 5–7 are inverted for conformity with the illustration of FIG. 4.

It will be understood therefore, that, in accordance with this invention, where the end walls of the ventilator have gaps 57 and 63 between adjacent tabs in a row, at those locations there is no resistance caused by the end walls 45 or 49, to the arcuate bending of the ventilator, from a position in which the ventilator is more flat than that shown in FIG. 1, to the arcuate bent configuration for the ventilator as shown in FIG. 1.

It will also be understood from the forgoing that various modifications may be made in the details of construction of the ventilator of this invention, as well as in the use and operation thereof, all within the spirit and scope of the invention as defined in the appended claims.

What is claimed is:

1. A roofing ridge ventilator for venting a roof for air passage between the interior of a roof and the outside ambient through sides of the ventilator and through ends of the ventilator; the ventilator being adapted to be installed longitudinally overlying an open ridge of a roof; the ventilator being sufficiently flexible to be arcuately bent to accommodate a variety of different roof pitches; the ventilator comprising:

(a) an elongate top wall having a predetermined length and width and top and bottom surfaces;

(b) a pair of outer side walls, each one integrally formed along the longitudinal length of and depending from a respective bottom surface of said top wall and at a predetermined angle with respect to said top wall, with each of said side walls including a plurality of apertures extending therethrough for air passage therethrough;

(c) a pair of upturned edge members, each one integrally formed with and extending from a respective distal end of said outer side wall opposite said top wall and extending along the longitudinal length of, and at a predetermined angle with respect to, a said side wall, said upturned edge members extending toward said top wall a predetermined distance to effectively shield at least a portion of said apertures;

(d) a plurality of brace members positioned at predetermined intervals along the length of said bottom surface of said top wall, for engagement with a roof surface;

(e) a pair of transverse end walls, one each integrally formed along opposite ends of the ventilator, with each end wall being discontinuous at a center section thereof and comprised in said center section of a plurality of tabs depending from the bottom surface of the top wall and disposed in a first transverse row, with said tabs in said first transverse row at each end wall being transversely spaced apart from each other to define first gaps for air passage therebetween when the ventilator is installed on a roof;

(f) with tabs in said first row being generally V-shaped, with the apex of the V-shape facing outwardly of the ventilator in the longitudinal direction;

(g) a second transverse row of tabs at each end of the ventilator, depending from and integrally formed with the bottom surface of the top wall and longitudinally spaced apart from the paths in said first row to define second gaps for air passage between said first and second rows of tabs when the ventilator is installed on a roof, with said tabs in said second transverse row being spaced apart from each other to define third gaps for air passage therebetween when the ventilator is installed on a roof;

(h) with tabs in said second row being generally V-shaped, with the apex of the V-shape facing inwardly of the ventilator in the longitudinal direction;

(i) whereby said first, second and third gaps cooperatively comprise means providing circuitous paths for air passage between the interior of a roof and the outside ambient, across ventilator end walls, when the ventilator is installed on a roof; and (j) whereby said first and third gaps permit arcuate bending of the ventilator without providing end wall resistance to arcuate bending resulting from end wall continuity.

2. The ventilator of claim 1, wherein the apex of each of the tabs in each said second row is longitudinally aligned with a said first gap in said first row.

3. The ventilator of claim 1, wherein a sheet of filter material is carried by the ventilator, underlying said rows of tabs, underlying portions of said brace members and underlying a center section of the ventilator and extending longitudinally of said ventilator.

* * * * *